United States Patent [19]

L'Heureux

[11] Patent Number: 4,924,969

[45] Date of Patent: May 15, 1990

[54] ACOUSTIC DOOR

[76] Inventor: Ghislain L'Heureux, 911, rang St-Antoine, St Féréol Les Neiges (Quebec), Canada, G0A 3R0

[21] Appl. No.: 342,360

[22] Filed: Apr. 24, 1989

[30] Foreign Application Priority Data

Nov. 9, 1988 [CA] Canada ..... 582657

[51] Int. Cl.[5] ..... E04B 1/82

[52] U.S. Cl. ..... 181/290; 181/287

[58] Field of Search ..... 181/284, 285, 287, 290, 181/291, 295

[56] References Cited

U.S. PATENT DOCUMENTS

| | | | |
|---|---|---|---|
| 1,931,125 | 10/1933 | Balduf | 181/290 X |
| 2,406,942 | 9/1946 | Buttner | 181/287 X |
| 3,215,225 | 11/1965 | Kirschner . | |
| 3,249,178 | 5/1966 | Watters . | |
| 3,319,237 | 5/1967 | Wehe, Jr. | 181/290 |
| 3,506,088 | 4/1970 | Sherman | 181/290 |
| 4,621,709 | 11/1986 | Naslund | 181/284 |

FOREIGN PATENT DOCUMENTS

| | | |
|---|---|---|
| 385666 | 12/1939 | Canada . |
| 708393 | 4/1965 | Canada . |
| 795567 | 10/1968 | Canada . |
| 808440 | 3/1969 | Canada . |
| 858917 | 12/1970 | Canada . |
| 928626 | 6/1973 | Canada . |
| 1026526 | 2/1978 | Canada . |
| 1034860 | 7/1978 | Canada . |
| 1131513 | 9/1982 | Canada . |

*Primary Examiner*—Benjamin R. Fuller

*Attorney, Agent, or Firm*—Bacon & Thomas

[57] ABSTRACT

An acoustic door comprises a frame as well as a first panel of gypsum mounted on the frame and having its outer face covered with a sheet of metal and its inner face covered with a layer of lead (Pb) to thereby form a first rigid wall. A second panel of gypsum of different thickness has also its outer face covered with a sheet of metal and its inner face covered with a layer of lead to form a second rigid wall. A strip of flexible material adhesive on both sides thereof is used to mount the second wall on the assembly frame-first wall while establishing no acoustic short circuit between them. The first and second walls are relatively thin while being sufficiently rigid whereby the space of air between the two layers of lead is maximized. This air space also contains acoustic insulation including fibers set into vibration to transform the mechanical energy of sound waves into heat. On the outside of the door, only a peripheral space exists between the two above-mentioned sheets of metal, which space is filled with a fire resistant, silicone sealant.

14 Claims, 1 Drawing Sheet

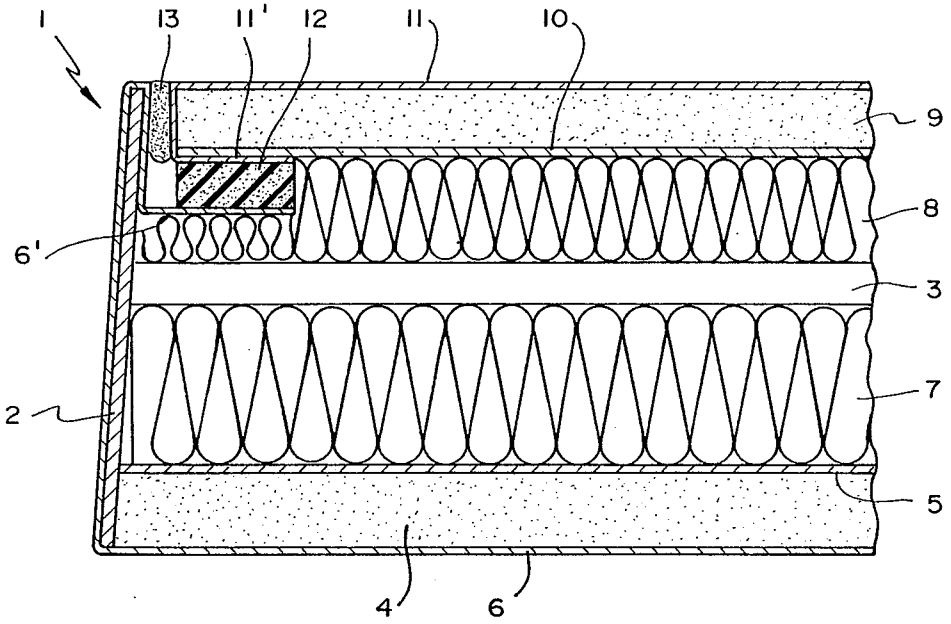
1
13
11'
12
11
10
9
8
3
7
5
6'
2
4
6

ACOUSTIC DOOR

BACKGROUND OF THE INVENTION

1. Field of the Invention

The present invention relates to a metal clad door whose structure and materials are selected in view of improving its acoustic insulation properties.

2. Brief Description of the Prior Art

A plurality of metal clad, acoustic doors are presently known and/or available on the market, of which one is described and claimed in Canadian patent No. 858.917 (SHERMAN) issued on Dec. 22, 1970.

The door of the above-mentioned patent comprises a principal panel as well as a floating panel connected together through a rubber extrusion. However, the latter extrusion does not fully insulate the principal and floating panels from each other. Indeed, a mechanical interconnection exists between the exterior sheet metal covering of the two panels at the bottom of the door, which interconnection establishes an acoustic short circuit. This acoustic short circuit enables direct transmission of sound waves from one side of the door to the other side thereof.

Moreover, a fiberglass insulation is confined within the interior of the door and consequently does not contribute in acoustically insulating the door. More specifically, the fibers cannot move, and accordingly do not vibrate to transform the mechanical energy of the acoustic waves into heat to thereby eliminate the same.

The space of air within the door of the above-mentioned Canadian patent is also too small. This creates a frequency mass-air-mass causing an effect of spring into resonance between the two panels at low frequency within the frequency range of interest, namely 125–4000 Hz. Acoustic waves at this resonance frequency can accordingly be transmitted through the space of air from one mass to the other to cause a lack of sound insulation at this frequency.

Moreover, the above-mentioned rubber extrusion is apparent from the outside of the door. Therefore, the metal clad door of Canadian patent No. 858.917 is not fire resistant as the rubber of the extrusion is combustible and exposed to the fire on the outside of the door.

OBJECT OF THE INVENTION

An object of the present invention is therefore to eliminate the above discussed drawbacks and other disadvantages of the prior art to produce a metal clad door presenting an improved acoustic insulation, and also capable of resisting to fire during long time periods.

SUMMARY OF THE INVENTION

More specifically, in accordance with the present invention, there is provided an acoustic door comprising:

a frame;

first and second opposite faces;

a first wall mounted on the frame and comprising (a) a first panel including a rigid, dense and viscoelastic material, and having a first coincidence frequency, an outer face and an inner face, (b) a first sheet of metal applied on the outer face of the first panel to define the first face of the door, and (c) a first layer of massive and very malleable material, preferably of lead (Pb), applied on the inner face of the first panel and having a second coincidence frequency higher than the first one;

a second wall comprising (a) a second panel including a rigid, dense and visco-elastic material, and having a third coincidence frequency, and outer face and an inner face, (b) a second sheet of metal applied on the outer face of the second panel to define the second face of the door, and (c) a second layer of massive and very malleable material, preferably of lead (Pb), applied on the inner face of the second panel and having a fourth coincidence frequency higher than the third one; and means for mounting the second wall on the assembly formed by the frame and the first wall while establishing no acoustic short circuit between this assembly frame-first wall and the second wall.

The first and second walls accordingly present a structure allowing these first and second walls to be relatively thin while being sufficiently rigid, so as to maximize a space of air between the first and second layers of massive and very malleable material and thereby reduce the frequency mass-air-mass at which acoustic waves can be transmitted from one of the first and second layers of massive and malleable material to the other of these two layers through the air in the latter space.

In the present disclosure and in the appended claims, the expression "coincidence frequency" indicates the frequency at which an acoustic wave can set into vibration a given material.

In accordance with a preferred embodiment of the invention, the first and second panels are panels of gypsum having different thicknesses and accordingly different coincidence frequencies, whereby no diaphragm effect is caused between the first and second walls which diaphragm effect would enable transmission of acoustic waves through the door at a coincidence frequency common to the first and second walls.

In accordance with another preferred embodiment of the invention, an insulating material is disposed in the maximized space of air between the first and second layers of massive and very malleable material, which insulating material comprises fibers set into vibration by any acoustic wave propagating within the space of air to thereby transform the energy of the acoustic wave into heat and accordingly damp it.

Still in accordance with a preferred embodiment of the invention, the assembly frame-first wall comprises around all of the door a corner formed by the intersection of two surfaces for receiving the second wall, and the means for mounting the second wall on the assembly frame-first wall comprises a strip of flexible material having a first adhesive surface applied on one of the two surfaces of the corner, and a second adhesive surface applied on the second wall.

Advantageously, the door is completely clad, except for a peripheral space between the first and second sheets of metal, a fire resistant, silicone sealant filling the latter peripheral space for thereby producing an acoustic door resisting to fire during long time periods.

BRIEF DESCRIPTION OF THE DRAWINGS

The objects, advantages and other features of the present invention will become more apparent upon reading of the following non restrictive description of a preferred embodiment thereof given for exemplification only with reference to the appended drawings of which the unique Figure represents a partial cross section of an acoustic door in accordance with the invention, showing the different materials used in its construction.

DETAILED DESCRIPTION OF THE PREFERRED EMBODIMENT

Referring to the unique Figure of the drawings, the metal clad door 1 conventionally comprises a steel frame. Such a frame is formed of ⅛" thick steel bars such as 2. Of course, the respective steel bars 2 forming the two sides of the door 1, as well as the top and bottom of the same are welded together at the four corners. As it is apparent from the unique Figure of the drawings, the steel frame formed by the bars 2 is slightly beveled in order to facilitate adjustment thereof in the frame on which the door 1 is mounted.

Conventionally, the frame of the door 1 is also provided in the space 3 of two steel counter-braces (not shown) of U-shaped cross section and respectively interconnecting the opposite corners of the frame to thereby define an "X". Additional flat steel counter-braces (not shown) are also lying in the space 3 and interconnect together the side bars 2. These flat counter-braces are transversal and horizontal, and are distributed vertically.

The above described steel frame is conventional and well known in the art, and it is accordingly believed unnecessary to further describe it in the present description.

The acoustic door 1 comprises, as illustrated in the unique Figure, a first panel 4 of gypsum which can be ½" thick. The gypsum is of course a rigid, dense and visco-elastic material. On the inner face of the panel 4 is applied a thin layer of lead (Pb), preferably under the form of a sheet 5 glued on the panel 4 by means of contact glue. On the outer face of the panel 4 of gypsum is applied a sheet 6 of steel again by means of contact glue. As can be appreciated, the sheet 6 of steel defines one of the two opposite faces of the door 1. The assembly panel 4 - layer 5 - sheet 6 forms a first wall of the door.

The steel sheet 6 is, on the periphery of the corresponding face of the door 1, folded to cover the metal bars 2 around all of the door to thereby define a peripheral edge surface thereof. The sheet 6 of steel is thereafter again folded over itself substantially at the level of the plane in which lies the other face of the door 1 to cover a portion of the inner surface of the steel bars 2, and is finally folded toward the interior of the door to form an internal flange 6' around all of the door 1. Again, the sheet 6 of steel can be applied on the bars 2 by means of contact glue.

A first, 1" thick layer 7 of fiberglass insulation is disposed between the sheet 5 of lead and the counter-braces mounted in the space 3.

A second, ⅝" thick layer 8 of fiberglass insulation is disposed on the other side of the counter-braces.

The door 1 further comprises a second panel 9 of gypsum thinner than the panel 4, for example ⅜" thick. On the inner face of the panel 9 of gypsum is applied a second, thin layer of lead (Pb). The latter layer of lead is under the form of a sheet 10 glued on the inner face of the panel 9 by means of suitable contact glue. On the outer face of the same panel 9 of gypsum is applied again by means of contact glue a sheet 11 of steel defining the other of the two opposite faces of the door 1. Around all of the panel 9, the sheet 11 of steel is folded to cover the peripheral edge surface of the panel, as well as a peripheral strip of the sheet 10 of lead to thereby form an inner border 11' around all of the panel 9. Again, the sheet 11 of steel can be applied on the peripheral edge surface of the panel 9 and on the peripheral strip of the sheet 10 of lead by means of contact glue.

The second wall of the door constituted by the panel 9 and the sheets 10 and 11 is mounted on the assembly frame-first wall by means of a strip 12 made of flexible material and adhesive on two opposite surfaces thereof. A first adhesive surface of the strip 12 is firstly applied on the flange 6' around all of the door 1. Thereafter, the border 11' of the second wall is applied on the other adhesive surface of the strip 12. It should be noted that the adhesive on the two surfaces of the strip 12 must be aggressive enough to fixedly attach the second wall to the assembly frame-first wall.

The second wall has dimensions selected so as to define a space between the sheets 6 and 11 made of steel. The latter space is filled with a silicone sealant 13.

As the structure of the door 1 according to the invention has now been described in detail in the foregoing description, the utility and/or contribution of each material with respect to acoustic insulation will now be given in detail hereinafter.

First of all, the flexible material of the strip 12 can be urethane foam, rubber foam or a rubber flexible enough to cause a mechanical disconnection stopping sound vibration between the assembly frame-first wall and the second wall.

In the same manner, the silicone sealant 13 is also flexible enough to cause a mechanical disconnection between the sheets 6 and 11 made of steel. Moreover, the silicone sealant 13 is fire resistant. The sealant 13 is advantageously the one sold and commercialized under the trademark DOW CORNING, Catalogue No. 2000. As the outside of the door 1 is completely covered with the sheets 6 and 11 made of steel and with the silicone sealant 13, the door is capable of resisting to fire during many hours as required by certain standards presently in force in Canada with respect to building construction.

As can be appreciated, no acoustic short circuit exists between the steel sheets 6 and 11, that is between the two opposite faces of the door 1. This is very important in order to obtain an adequate acoustic insulation.

Of course, the sound waves propagating from one side of the door 1 to the other side thereof are firstly transmitted to the corresponding sheet 6, 11 of steel, which sound waves setting into vibration the sheet of metal. As no mechanical interconnection exists between the sheets 6 and 11, these vibrations cannot be transmitted directly from one of these sheets to the other, as they are stopped by the strip 12 of flexible material and the silicone joint 13.

One skilled in the art knows the gypsum as a rigid, dense and visco-elastic material. It accordingly increases the mass and rigidity of the outer sheet 6, 11 of steel to make the same more difficult to set into vibration.

Regarding the lead, it is very heavy (massive) and very malleable and therefore has a high coincidence frequency. When the gypsum tends to vibrate, the lead damps these vibrations.

The sheet 6, 11 of steel, the panel 4, 9 of gypsum, and the sheet 5, 10 of lead therefore have different coincidence frequencies. Accordingly, when the sheet 6, 11 of steel tends to vibrate, the panel of gypsum 4, 9 and the sheet 5, 10 of lead damp these vibrations, and in the same manner, when the panel 4, 9 of gypsum tends to vibrate, the sheet 5, 10 of lead damps these vibrations. Following the same principle, when the sheet 5, 10 of lead tends to vibrate, the panel 4, 9 of gypsum damps these vibrations.

Moreover, as mentioned hereinabove, the panels 4 and 9 made of gypsum have different thicknesses, and accordingly different coincidence frequencies, whereby no diaphragm effect is caused between the first and second walls. Such a diaphragm effect is produced when the two panels 4 and 9 have the same thickness and accordingly a common coincidence frequency and enables transmission of acoustic waves through the door at this common coincidence frequency.

As the panels 4 and 9 are relatively thin while being sufficiently rigid, the space of air within the door between the sheets 5 and 10 of lead is maximized taking of course into consideration the global thickness of the door 1. Accordingly, the latter space of air is large enough to allow the fibers of the two layers 7 and 8 of fiberglass insulation to move and therefore to vibrate in response to the mechanical energy carrying the sound vibrations to transform these vibrations into heat and thereby absorb the vibratory energy of the sound waves. Moreover, as the space of air between the sheets 5 and 10 of lead is maximized, the frequency mass-air-mass is minimized and is located outside the frequency range of interest, that is 125–4000 Hz. The frequency mass-air-mass is the critical frequency at which the air produces an effect, comparable to a spring into resonance, between the two sheets 5 and 10 of lead to enable transmission of acoustic waves between these two sheets. The use of two layers 5 and 10 of lead having a high inertia, contributes in reducing the value of this frequency mass-air-mass.

The two layers 7 and 8 of fiberglass insulation are advantageously constituted by the insulation AW, Type II, manufactured and commercialized by the company Fiberglass Canada Inc. This insulation is an incombustible wool having a color varying from nearly white to light beige and formed of long, inorganic and flexible glass fibers bound together by means of a thermosetting resin. It is available under the form of braids.

Consequently, as evidenced in the foregoing description, each material used in the construction of the acoustic door 1 according to the invention as well as their arrangement are selected in view of preventing transmission of sound vibrations from one side of the door 1 to the other side thereof.

Of course, it is very important to design the doorknob and the lock so as to cause no acoustic short circuit between the sheets 6 and 11 made of steel. Any type of doorknob and lock can be used, provided they cause no mechanical connection between the two walls of the door 1. Of course, this also applies to the spy-hole.

Moreover, when the door is mounted on a metal frame, the latter can be filled with strips of gypsum to make the frame massive and thereby damp the vibrations. Indeed, according to the law of mass, the frame becomes more difficult to set into vibration and the transmission of vibrations by the metal frame is accordingly reduced. In the same manner, any efficient sound insulating strip between the door 1 and the frame on which it is mounted can be used.

Practical experiments have demonstrated without any doubt that the door according to the present invention improves substantially the acoustic insulation, in comparison with the level of insulation provided by the metal clad doors actually known and/or available on the market, including that of the above discussed Canadian patent No. 858.917.

Although the present invention has been described in detail hereinabove by way of a preferred embodiment of the acoustic door, it should be pointed out that any modification to this preferred embodiment, within the scope of the appended claims, is not deemed to change or alter the nature and scope of the subject invention.

What is claimed is:

1. An acoustic door comprising:

a frame;

first and second opposite faces;

a first wall mounted on the said frame and comprising (a) a first panel including a rigid, dense and visco-elastic material, and having a first coincidence frequency, an outer face and an inner face, (b) a first sheet of metal applied on he outer face of the first panel to define the first face of the said door, and (c) a first layer of massive and very malleable material applied on the inner face of the said first panel and having a second coincidence frequency higher than the said first coincidence frequency;

a second wall comprising (a) a second panel including a rigid, dense and visco-elastic material, and having a third coincidence frequency, an outer face and an inner face, (b) a second sheet of metal applied on the outer face of the second panel to define the said second face of the door, and (c) a second layer of massive and very malleable material applied on the inner face of the second panel and having a fourth coincidence frequency higher than the said third coincidence frequency; and means for mounting the second wall on an assembly formed of said frame and of the first wall while establishing no acoustic short circuit between the said assembly and the said second wall;

the first and second walls accordingly presenting a structure allowing the said first and second walls to be relatively thin while being sufficiently rigid, so as to maximize a space of air between the first and a second layers of massive and very malleable material and thereby reduce the frequency mass-air-mass at which acoustic waves can be transmitted from one of the first and second layers of massive and malleable material to the other of said layers through the air in the said space.

2. An acoustic door according to claim 1, wherein the first and second panels have different thicknesses and also different coincidence frequencies, whereby no diaphragm effect is caused between the first and second walls which diaphragm effect would enable transmission of acoustic waves through the door at a coincidence frequency common to the said first and second walls.

3. An acoustic door according to claim 1, wherein the said first and second panels are panels of gypsum.

4. An acoustic door according to claim 2, wherein the said first and second panels are panels of gypsum.

5. An acoustic door according to claim 1, further comprising an insulating material disposed in the space of air between the first and second layers of massive and very malleable material, said insulating material comprising fibers set into vibration by any acoustic wave propagating within the said space of air to thereby transform energy of said acoustic wave into heat.

6. An acoustic door according to claim 2, further comprising an insulating material disposed in the space of air between the first and second layers of massive and very malleable material, said insulating material comprising fibers set into vibration by any acoustic wave propagating within the said space of air to thereby transform energy of said acoustic wave into heat.

7. An acoustic door according to claim 1, in which:

said first sheet of metal is, in a periphery of the first face of the door, folded a first time to define a peripheral edge surface of the said door, and thereafter folded a second time over itself substantially at a level of a plane in which lies the second face of the door, and finally folded a third time toward an interior of the door to form an internal flange around all of the said door;

said second sheet of metal, is, in a periphery of the second panel, folded to cover a peripheral edge surface of the said second panel as well as a peripheral strip of the second layer of massive and very malleable material applied on the inner face of the second panel so as to form an inner border; and the said mounting means comprise a strip of flexible material comprising a first adhesive surface applied on the internal flange formed by the first sheet of metal, and a second adhesive surface applied on the inner border formed by the second sheet of metal.

8. An acoustic door according to claim 7, in which the first and second sheets of metal are separated, in the periphery of the second wall, by a space filled with a sealant comprising a fire resistant, flexible material.

9. An acoustic door according to claim 8, wherein the said sealant comprises silicone as basic material.

10. An acoustic door according to claim 1, in which said means for mounting the second wall on the said assembly frame-first wall comprises a strip of flexible material having two opposite and adhesive surfaces.

11. An acoustic door according to claim 10, in which the assembly frame-first wall comprises around all of the door a corner formed by the intersection of two surfaces for receiving the second wall, one of the two adhesive surfaces of the strip being applied on one of the two surfaces of the corner and the other of the said two adhesive surfaces being applied on the second wall.

12. An acoustic door according to claim 1, in which the first and second layers of massive and very malleable material are constituted by two sheets of lead respectively applied on the inner faces of the first and second panels.

13. An acoustic door according to claim 12, wherein the sheets of lead are glued on the inner faces of the first and second panels.

14. An acoustic door according to claim 1, wherein the first and second sheets of metal are glued on the outer faces of the first and second panels, respectively.

* * * * *